United States Patent [19]

Sturman et al.

[11] Patent Number: 4,602,405

[45] Date of Patent: Jul. 29, 1986

[54] CONTAINERS PROVIDED WITH SEALABLE SLIDING FASTENERS

[75] Inventors: Michael G. Sturman, Biggin Hill; David G. Cansdale, Crockenhill, Near Swanley, both of England

[73] Assignee: Bond (R.S.C.) Associates, Ltd., London, England

[21] Appl. No.: 550,212

[22] Filed: Nov. 9, 1983

[30] Foreign Application Priority Data

Nov. 10, 1982 [GB] United Kingdom ..... 8232121
Mar. 31, 1983 [GB] United Kingdom ..... 8308993

[51] Int. Cl.[4] ..... A44B 19/26; A44B 19/30

[52] U.S. Cl. ..... 24/385; 24/418; 292/307 R

[58] Field of Search ..... 383/5; 70/68; 292/307, 292/318, 327, 323; 206/810; 24/385, 418, 387, 436

[56] References Cited

U.S. PATENT DOCUMENTS 2,677,952 5/1954 Stue ..... 24/387 X
2,915,798 12/1959 Hewitt, Jr. ..... 24/387
3,078,897 2/1963 Rifkin ..... 383/97 X
3,653,236 4/1972 Kerr ..... 24/387 X
3,759,073 9/1973 Rifkin ..... 24/387 X
3,955,842 5/1976 Edwards ..... 292/307 R
4,008,914 2/1977 Anderson ..... 70/68
4,062,090 12/1977 Moolenaars ..... 24/387

FOREIGN PATENT DOCUMENTS 698325 11/1964 Canada ..... 24/387
108032 6/1958 Pakistan ..... 70/68
854784 11/1960 United Kingdom ..... 24/387

*Primary Examiner*—William E. Lyddane
*Assistant Examiner*—Peter A. Aschenbrenner
*Attorney, Agent, or Firm*—James C. Wray

[57] ABSTRACT

The invention provides a sealable slide fastener including a puller (20) for the slider and having sealing means comprising a fixing means (18, 19) fixed to the container and extending over the fastener at one end thereof, and having means to locate the puller with the free end of the puller (20) directed from the slider towards the opposite end (14) of the fastener, and a frangible seal member (21) having locking means (41, 42) engageable with the puller to lock it on to the fixing means, said locking means having a spring-in engageability with the fixing means.

6 Claims, 15 Drawing Figures

CONTAINERS PROVIDED WITH SEALABLE SLIDING FASTENERS

BACKGROUND TO THE INVENTION

This invention relates to containers provided with sealable slide fasteners for closing the containers.

STATEMENT OF PRIOR ART

It is known to provide envelopes of plastics material with slider (zip) fasteners and to seal these for security with plastics seals which have a spring-in engagement with locking means fixed to the envelope. While these are generally satisfactory it has been found that they are not completely tamper proof because it is possible to feed the "zip" through the slider to gain access to the contents of the envelope whereupon the zip can be restored to its normal position.

SUMMARY OF THE INVENTION

According to the present invention we provide a container provided with a slider fastener including a puller for the slider and having a sealing means comprising a fixing means fixed to the container and over the fastener at one end thereof, and having means to locate the puller with the free end of the puller directed from the slider towards the opposite end of the fastener, and a frangible seal member having locking means engageable with the puller to lock it on to the fixing means, said locking means having a spring-in engageability with the fixing means.

The base member may have locating abutments to locate the puller in position with its free end directed towards said opposite end fastener.

The seal member may have a flange extended beyond the puller in the direction towards said opposite end of the fastener whereby it can be lifted by the fingers to break the locking means.

BRIEF DESCRIPTION OF DRAWINGS

The invention will be further described by way of example with reference to the accompanying diagrammatic drawings wherein:

FIG. 6 to 12 show a modification wherein:

FIG. 6 is a plan view of a base member;

FIG. 7 is an end view thereof;

FIG. 8 is a plan view of a puller attached to a slider;

FIG. 9 is a plan view of a back plate;

FIG. 10 is an end view thereof;

FIG. 11 is a plan view of a frangible seal;

FIG. 12 is an end view thereof; and

DESCRIPTION OF PREFERRED EMBODIMENTS

Figure 1:
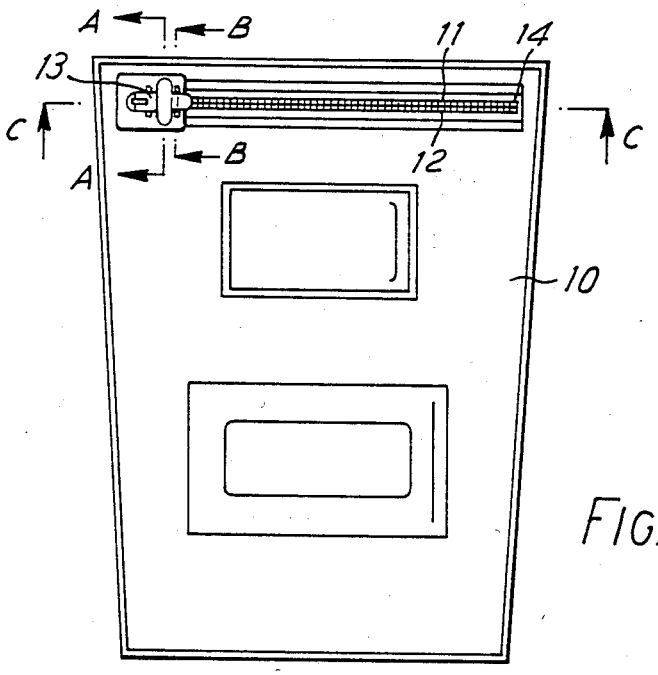
FIG. 1 is a plan view of a container made in accordance with the invention.
Figure 2:
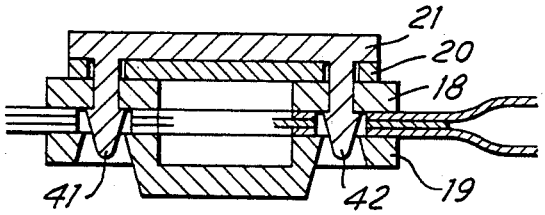
FIGS. 2, 3 and 4 are sectional views thereof on the planes A—A, B—B, C—C on FIG. 1 respectively.
Figure 3:
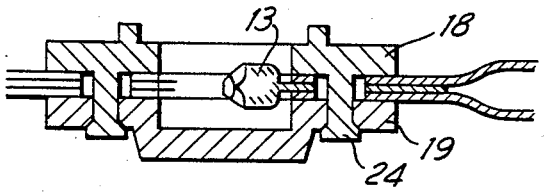

A plastics envelop 10 is provided with a slide fastener comprising two lines 11,12 of teeth engageable with each other by means of a slider 13.

The sealing means consist of four parts viz., a base member 18, a back plate 19, a puller 20 and a frangible seal 21 located at one end of the fastener. The opposite permanently closed end of the fastener is at 14.

The base member 18 and the back plate 19 serve as fixing means which are fixed together on opposite sides of the envelope by integral parts 24 of the base member.

The base member 18 is U-shaped to provide a central slot 25 in line with the interlocking teeth 11,12. The back plate has a corresponding groove 27. The slider 13 can be pulled into the slot 25.

Figure 4:
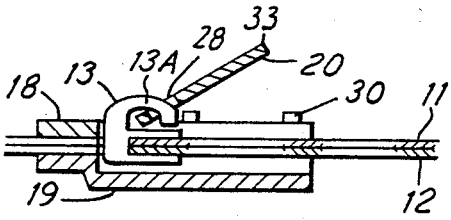
Figure 5:
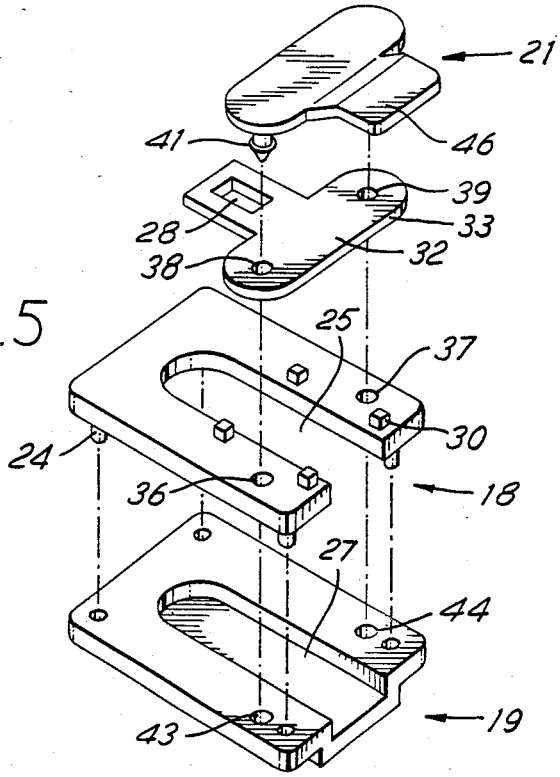
FIG. 5 is an "exploded" view of the sealing elements.
Figure 6:
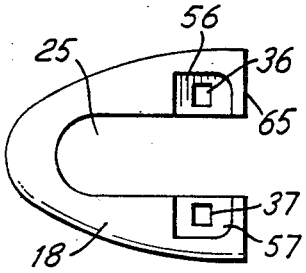
Figure 7:
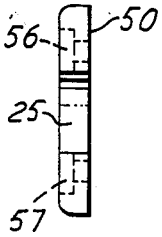
Figure 8:
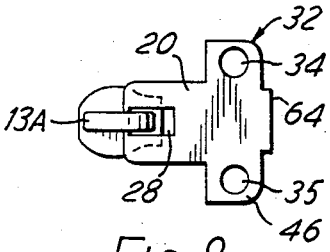
Figure 9:
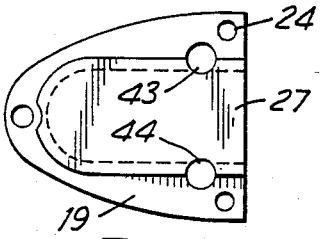
Figure 10:
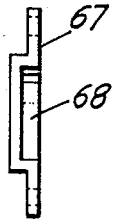
Figure 11:
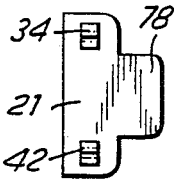
Figure 12:
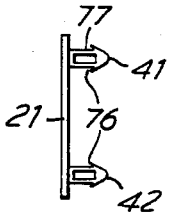

The puller 20 is loosely attached to the slider 13 by means of an aperture 28 engaged by a hook 13A of the slider 13 (see FIG. 4).

The base member has four upstanding locating blocks or pins 30. The puller has a flat extension 32 shaped to fit in the space between the locating blocks 30 with its free end 33 directed towards the opposite end 14 of the fastener.

The base member has holes 36,37 and the puller 20 has corresponding holes 38,39. The seal 21 has frangible pins or pegs 41,42 having tapered ends and shoulders so that they can be pushed through the holes 36,37,38,39 with a spring-in engagement so that the shoulders engage the back of the base member. The seal 21 then can only be removed by breaking the pegs.

The back plate also has holes 43,44 to receive the ends of the pegs.

The seal 21 is provided with a flange 46, the free end of which is directed towards the closed end 14 of the fastener. The flange 46 is stronger than the pegs so that by lifting the flange the pegs 41,42 are broken and the fastener can then be opened.

By this arrangement it is not possible to feed the lines 11,12 back through the sealed lock to effect unauthorised access to the contents of the container.

In the modified construction shown in FIGS. 6 to 12:

The base member 18 is approximately triangular and has a central slot 25 open at one end. On each side of the slot near its open end is a hole 36,37 and surrounding these holes are recesses 56,57.

A puller 20 is approximately T-shaped so as to fit loosely within the slot 25 and recesses 56,57 with its end towards the permanently closed end of the slide fastener as shown in FIG. 1. The puller 20 is attached to the slider 13 of the fastener and has holes 34,35 corresponding to the holes 36,37 in the base member. The puller may have a small extension 64 to extend level with the outer edge of the base member.

A back plate 19 is of the same shape as the base member 18 and has a central recess 27 to accommodate the end of the slide fastener. The back plate 19 has three holes 24 one at each corner through which plastics material can be moulded and fixed to the base member with the material of the container clamped between them. The back plate also has holes 43,44 corresponding to the holes 36,37.

A frangible seal member 21 is in the form of a thin plate of plastics material having two projections 41,42 which are resilient so that they can be pressed through the holes 36,37 and will expand to engage their shoulders 76 under the back of the base member 18. The member 21 has a lip 78 which extends beyond the end 65 of the base member so that it can be engaged by a finger and lifted whereupon the projections 41,42 break off from the plate 21 and the fastener can then be opened.

The seal 20 is preferably a thin plate less than 2 mm thickness carrying two arrow head projections spaced apart from each other, said projections having shoulders for snap engagement with the fixing means, said arrow heads being connected to the plate by two frangible strips 77, the plate being housed within the slot 25 and recesses 56,57 of the base member 18 when in the sealing position.

Figure 13:
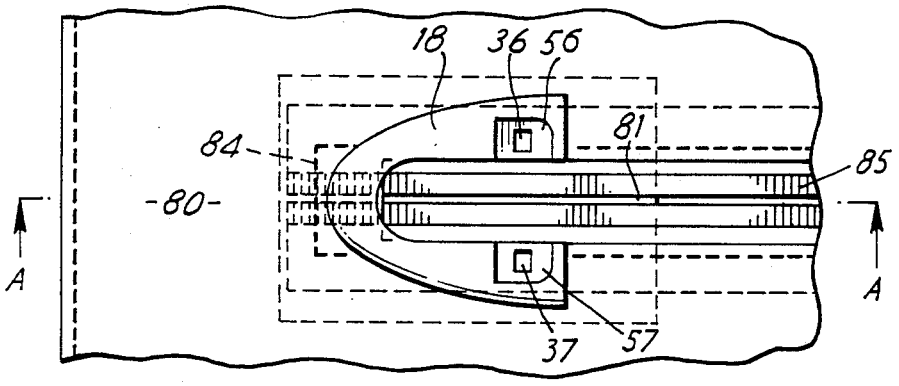
FIGS. 13, 14 and 15 show a modified construction.
Figure 14:
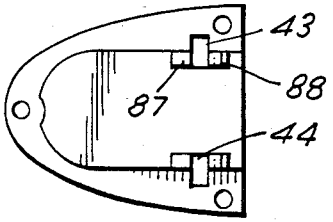
Figure 15:
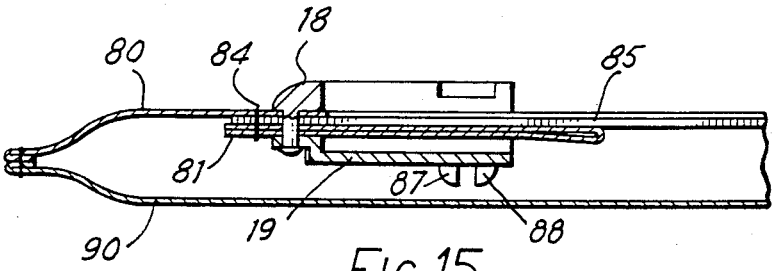

In the modified construction shown in FIGS. 13, 14 and 15 the back plate 19 is secured to the upper sheet 80 of a resealable envelope, with the interposition of a small rectangular piece of plastics material 81 sewn at 84 to the sheet 80. The fastener 85 is also sewn by the stitching 84 between the plastics material 81 and the upper sheet 80. The inside surface of the back plate is provided with a pair of projections 87,88 adjacent each hole 43,44 to space the back plate from the under sheet 90 of the bag to ensure that the pegs 41,42 can fall away when they break off from the head of the seal.

We claim:

1. A container having an opening and comprising a slide fastener having interlocking elements supported on the edges of the opening, a slider movable over the interlocking elements to engage and disengage them to close and open the opening, and a puller attached to the slider, said puller including a longitudinally extending body with at least one laterally extending portion;

locating means for locating the puller in its closing position, said locating means being fixed to the container and extending over an end portion of the interlocking elements; said locating means comprising a back plate extending longitudinally beneath the end portion of the interlocking elements and having a U-shaped recess in line with the interlocking elements and a U-shaped base member juxtaposed over and connected to the back plate, a sidewall of the container being sandwiched between the base member and back plate, the slider being disposed within the locating means with said at least one laterally extending portion overlying a portion of said back plate, and a free end of the puller directed from the slider towards the opposite end of the fastener thereby overlaying the end portion of the interconnecting elements; the at least one laterally extending portion of said puller, said back plate and said base member having vertically aligned apertures through rearward portions thereof; and a frangible seal member having locking means extending through the vertically aligned apertures, for locking the frangible seal on top of the puller.

2. A container as claimed in claim 1, wherein the puller extends beyond the locating means in the direction of said opposite end of the fastener to provide a lip for engagement by the finger of the user.

3. A container as claimed in claim 1, wherein the U-shaped base member has upwardly extending pins disposed around the overlaid puller.

4. A container as claimed in claim 1, wherein the U-shaped base member has two recesses, one on each side of the U-shaped base member, for receiving the puller.

5. A container as claimed in claim 1, wherein the frangible seal member is a plate of plastics material less than 2 mm. in thickness carrying two projections, each having an arrowhead at distal ends thereof having a shoulder to engage the U-shaped base member.

6. The apparatus of claim 1 wherein the locking means of the frangible seal comprises frangible projections extending downwardly from the frangible seal and passing through the vertically aligned apertures, the frangible projections having shoulders engaging a surface of the back plate.

* * * * *